United States Patent [19]

Exley

[11] 3,964,837

[45] June 22, 1976

[54] ECCENTRIC PASSAGE PIPE DIFFUSER

[75] Inventor: John T. Exley, Milford, Conn.

[73] Assignee: Avco Corporation, Stratford, Conn.

[22] Filed: Jan. 13, 1975

[21] Appl. No.: 540,601

[52] U.S. Cl. ..... 415/181; 415/211

[51] Int. Cl.[2] ..... F04D 21/00; F04D 29/42

[58] Field of Search ..... 415/211, 219 C, 181

[56] References Cited

UNITED STATES PATENTS

| | | | |
|---|---|---|---|
| 2,708,883 | 5/1955 | Keller et al. | 415/211 |
| 3,184,152 | 5/1965 | Bourguard | 415/181 |

FOREIGN PATENTS OR APPLICATIONS

| | | | |
|---|---|---|---|
| 195,561 | 2/1958 | Austria | 415/211 |
| 1,190,861 | 4/1959 | France | 415/211 |

*Primary Examiner*—Henry F. Raduazo

*Attorney, Agent, or Firm*—Charles M. Hogan; Irwin P. Garfinkle; Robert J. McNair, Jr.

[57] ABSTRACT

A diffuser is disclosed which provides intersecting passages extending outwardly from an inner circumference which closely surrounds the periphery of the impeller output stage of a centrifugal compressor. The passages are of curvilinear cross-section having entrance throat regions of an eccentric configuration designed to minimize the build-up of shock waves in the fluid flowing from the outlet of an impeller whose blade tips are traveling at supersonic speed. The configuration of the throat region is such that it closely matches the velocity vector profiles of fluid particles which leave the central region of an impeller blade at supersonic velocities and an appreciable angle above the tangential whereas particles leaving near the front and back shrouds of the impeller travel slower at angles approaching the tangential.

7 Claims, 6 Drawing Figures

ECCENTRIC PASSAGE PIPE DIFFUSER

BACKGROUND OF THE INVENTION

This invention relates to improvements in the construction of diffusers used with centrifugal compressors. Of particular concern are diffusers used in aircraft gas turbine engines. In these engines it is common practice to use a high pressure ratio compressor which delivers a compressible fluid, usually air, at high velocity to a diffuser wherein the fluid is decelerated to produce a pressure rise.

Many different types of diffusers have been built for use in aircraft gas turbine engines. U.S. Pat. No. 3,333,762 by Vrana describes a pipe diffuser capable of operating over a wide range of pressure rise through the compressor. U.S. Pat. No. 3,420,435 by Jarosz discloses means for overcoming the disadvantages of the complex construction exhibited when building diffusers according to the teachings of Vrana. Jarosz shows how tube sections of expanding cross section can be easily bent at their outward ends to redirect the compressed fluid in a direction generally parallel to the impeller axes. U.S. Pat. No. 2,967,013 by Dallenbach discloses an approach for taking supersonic flow into account. Leading edge profiles of the diffuser vanes are configured such that shock waves do not occur since they are relieved in the regions where the gas flow is supersonic.

My invention expands on the knowledge disclosed in the above-referenced patents. Test results show that a diffuser built according to the teachings of my invention has lower losses, hence greater efficiency, than is the case with previous designs.

SUMMARY OF THE INVENTION

The invention pertains to a diffuser used with a supersonic flow centrifugal compressor. The diffuser consists of a multiplicity of passages which intersect at an inner circumference which closely surrounds the periphery of the compressor impeller. Tests have shown that the fluid particles leaving the central region of the compressor impeller blades travel at supersonic velocities and at angles appreciably above tangential, whereas particles leaving the impeller near the front and back shrouds travel slower and at angles quite near the tangential.

It is, therefore, an object of this invention to provide an inlet shape for each of the passages, which is so constructed as to closely match the velocity vectors of the fluid particles coming from the impeller. The result is a passage centerline which is stepped near the innermost end. Specifically, the diffuser has an annular member mounted around the periphery of the impeller. The inner surface of the annular member is provided with a multiplicity of circumferentially spaced curvilinear passages extending tangentially outward from the inner surface. The radially outward facing wall of one passage intersects the radially inward facing wall of the next adjacent passageway to form the leading edge of each of the vanes of the diffuser. The leading edge of each vane when viewed edgewise is made to be elliptical to accommodate the transonic pressure waves coming from the impeller.

The cross-sectional dimension of each passageway is, to a large extent, determined by the axial width of the impeller blade. For the case where the cross section of each passageway is circular in nature, the diameter of the projected orifice, at the inner entrance of each passageway, will be approximately the same as the distance between the front and back shrouds of the impeller. If the centerline of this passageway is made to be tangent to a circle of approximately the same diameter as that of the impeller, the intersection of the passage thus formed and the inner diameter of the diffuser will appear as an ellipse. If adjacent passages are made to intersect and by so doing form the leading edges of vanes, then the total number of passages so formed will be directly dependent on the width of the impeller blade.

The intersecting passageways which appear as ellipses at the inner diameter of the diffuser, overlap in such a way as to form a continuous annular space at the entrance. This annular space completely surrounds the periphery of the impeller blades and receives the fluid output therefrom. The cross-sectional dimensions of each passage begins to enlarge in a special way soon after starting up the passage from the impeller diffuser interface. The radially outward facing phantom surface and the radially inward facing surface are parallel to each other for a short distance at their innermost ends. The radially inward facing surface then begins to enlarge until a point is reached which is opposite the outward facing wall. At this point the inward facing wall again becomes parallel to the outward facing wall. In practice this can be accomplished by the use of two different size drills. First, holes can be drilled in the diffuser stock which are of a diameter equal to the width of the impeller blade. This series of holes would be made sequentially through the diffuser stock so that the centerline of each hole is tangent to a circle of approximately the same size as the inner diameter of the diffuser. After making the first series of holes, a second set of cuts is made with a drill which is 5 to 20 percent larger in diameter than the first. The second cut is made parallel with the first but with the centerline of the second displaced with respect to the first such that there is a line of common tangency between the two along the radially outward facing wall of each passage. This second cut of holes is made from the outside edge of the diffuser stock. When the tool just reaches the inner circumference of the diffuser stock, cutting is stopped. A tapered cut is then made which gradually phases the big diameter passage into the small.

As a result, the effective centerline of the passage leading away from the diffuser impeller interface is eccentrically shaped. The result is an improvement in operating efficiency. The fluid particles coming off the central portion of the impeller at supersonic speed, readily pass into the enlarged throat of the diffuser passages. At the same time, the slower fluid particles coming off the impeller near the front and back shrouds can pass up that portion of each passage which is near the radially outward facing wall.

Once stable flow is established in the enlarged throat region, it is then possible to gradually expand the size of each passage. As the fluid traverses this region, it slows down and there is an increase in pressure.

BRIEF DESCRIPTION OF THE DRAWINGS

Having generally described the nature of the invention and how to go about making it, reference is made to the accompanying drawings, in which.

DESCRIPTION OF THE PREFERRED EMBODIMENT

Figure 1:
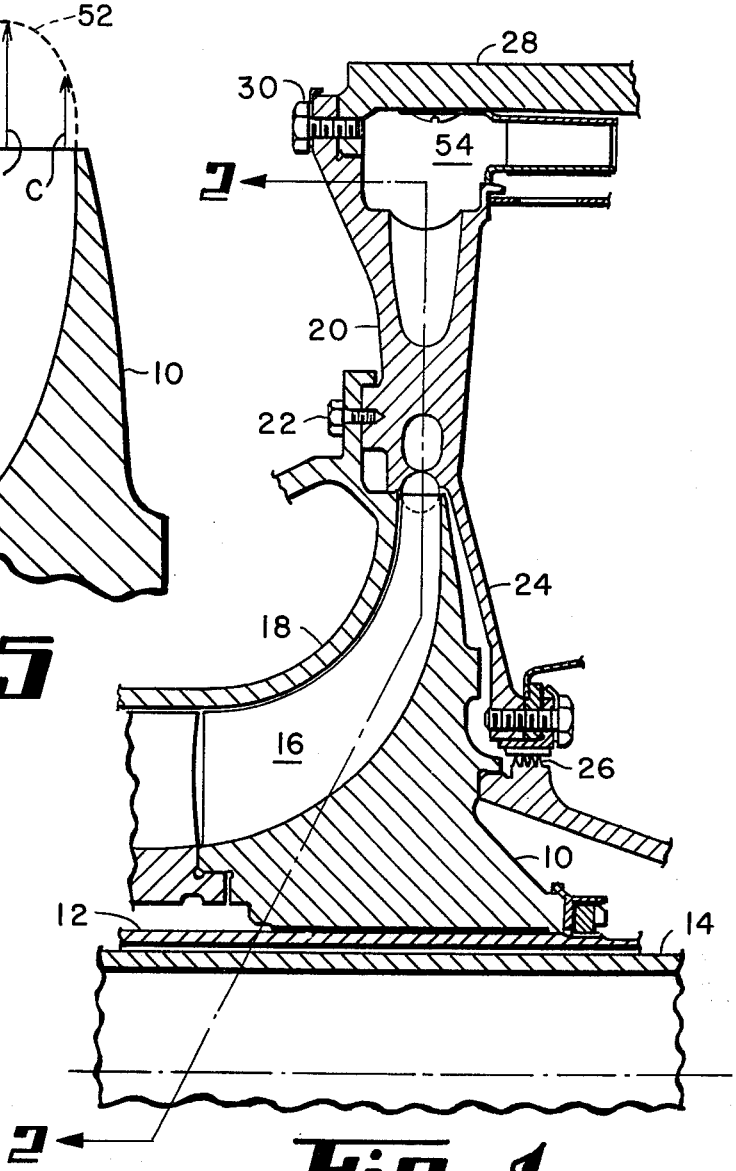
FIG. 1 shows, in part, the longitudinal cross section of the arrangement of the compressor and the diffuser when constructed in accordance with the invention.

In FIG. 1 there is shown an impeller rotor hub 10 keyed via spline teeth to hollow shaft member 12 which in turn is connected to drive shaft 14 at a location not shown. Impeller blade 16 is one of a multiplicity of such blades projecting from rotor hub 10. Circumferentially surrounding the impeller blade assembly is an exterior housing member 18. Radially outward from housing member 18 and completely surrounding the periphery of the impeller is diffuser 20. Diffuser 20 is connected to housing member 18 by a multiplicity of bolts 22. On the downstream side of impeller hub 10, the diffuser 20 extends inward to form back shroud 24 around the impeller. Rotary seal 26 prevents escape of pressurized gas particles. External housing member 28 serves as both a support for the diffuser assembly and as an external annulus for collecting the pressurized fluid. The diffuser is fastened to external housing 28 by a multiplicity of bolts 30.

Figure 2:
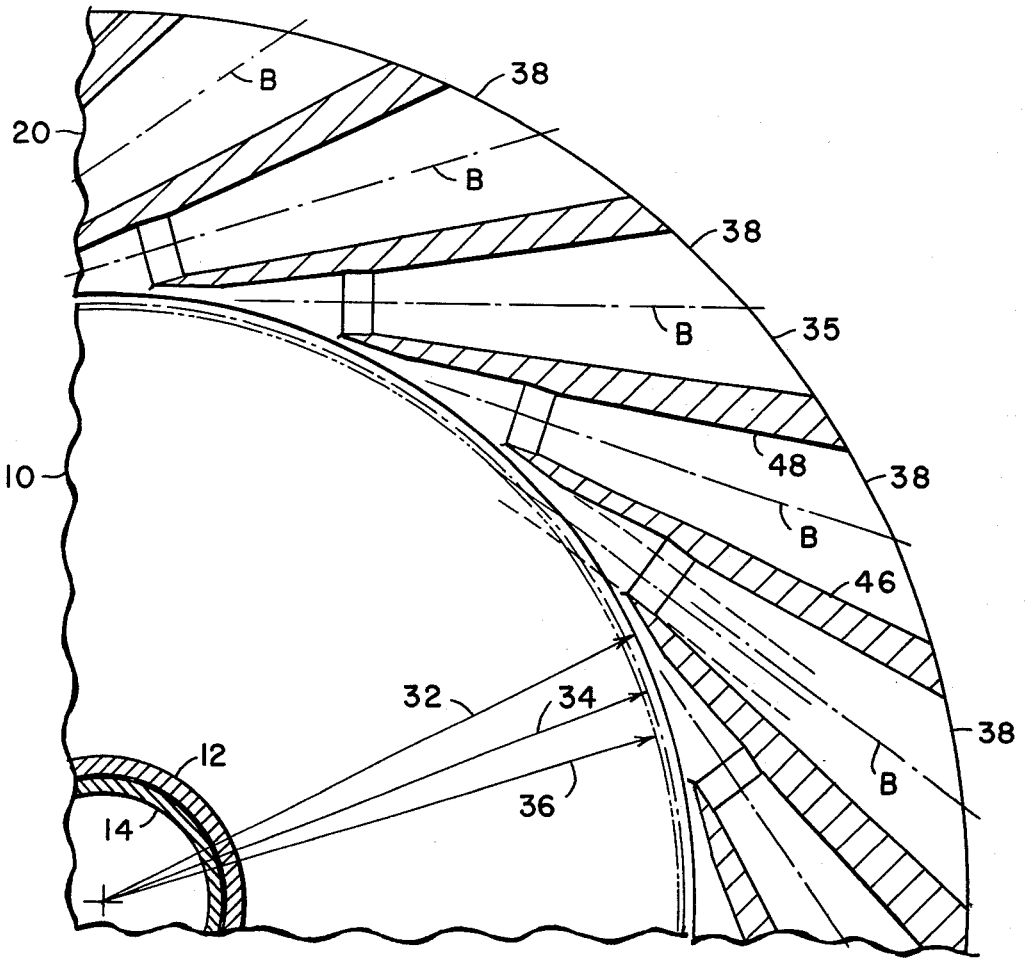
FIG. 2 is a cross-sectional view of the diffuser along line 2—2 of FIG. 1.

Referring now to FIG. 2, there is shown a cross-sectional view of diffuser 20 with impeller 10 shown in outline on driving shafts 12 and 14. Radius 32 is the inner edge of diffuser 20 whereas edge 35 represents its outer boundary. Radius 34 is the vector periphery swept out by impeller blades 16. A plurality of like intersecting passages 38 are formed in diffuser 20 in a manner hereinafter to be described.

Figure 3:
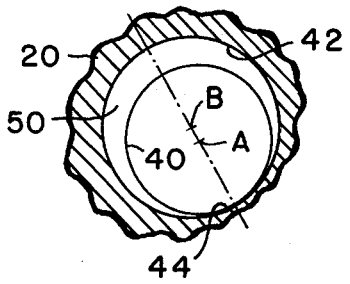
FIG. 3 is an enlarged view of the throat region of one of the diffuser passages shown in FIG. 2.

FIG. 3 shows an enlarged cross-sectional view of one of the multiplicity of the passageways 38 formed in diffuser 20. Cylindrical surface 40 is made parallel to the edge of cylindrical surface 44. This can be accomplished, for example, by drilling a hole having centerline A from the outer boundary edge 35 of the diffuser housing inward until it penetrates through the inner edge along radius 32. Centerline A is made tangent to a circle having a radius very nearly the same as that of the periphery of the impeller. In FIG. 2, the circle of tangency is shown as having radius 36. Further, in the unit reduced to practice, it was found that a total of nineteen passageways having centerline A were needed around the periphery of the diffuser. With 19 such passageways, the intersection of surface 40 of one passage and surface 44 of the next adjacent passage provided an appropriately sized annular entrance space.

Figure 4:
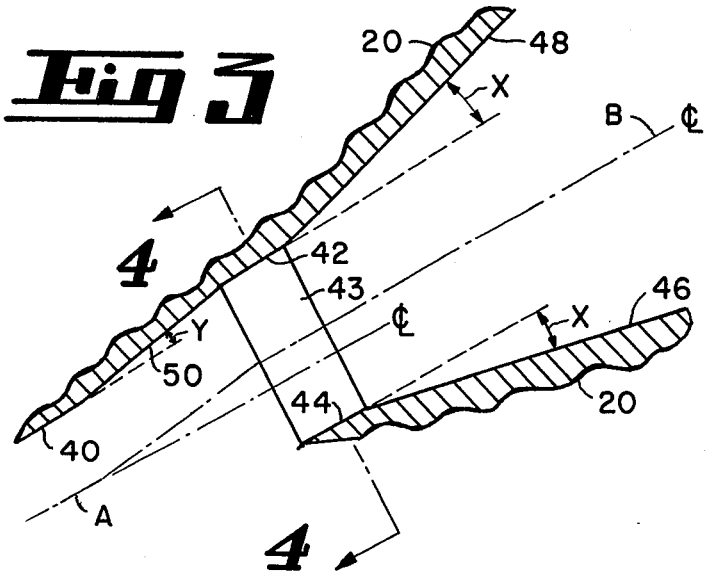
FIG. 4 is a cross-sectional view of the throat region of the passage taken along line 4—4 of FIG. 3.

Having made all of the multiplicity of passageways having centerline A, the next step is to make an enlarged throat section 43 which is shown in FIG. 3 as being within the cylindrical surfaces 42 and 44. This can be achieved, for example, by cutting a second set of passages, each of which is 5 to 20 percent larger than the first set. The larger passages would be cut inward from surface 35 along centerline B which is shifted to the side of centerline A just enough so that surface 44 maintains a line of tangency between the first and second cuttings. FIG. 4 shows an end-on view of what is depicted in FIG. 3.

After surfaces 40, 42 and 44 are formed the next step is to form a tapered section between the two throat regions. This is shown in FIGS. 3 and 4 as a conical surface 50. The angle that this tapered section makes with the inner and outer regions of the throat is shown as Y in FIG. 3. Typically, angle Y will vary between 1° and 10° with 5° being preferred. Finally, each passageway is enlarged at the exhaust end along an expanding angle X as shown in FIG. 3. The result, in the cross-sectional view of FIGS. 2 and 3, is the conical surfaces 46 and 48. In practice, it has been found that angle X can be in the range of 2° to 8°.

Figure 5:
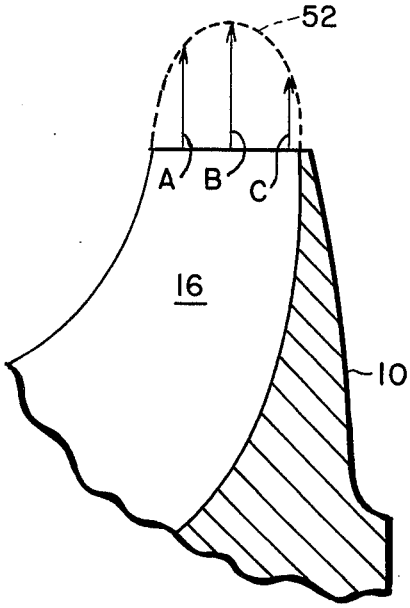
FIG. 5 is an enlarged view of the end of an impeller blade showing the velocity profile of particles as they enter the diffuser.
Figure 6:
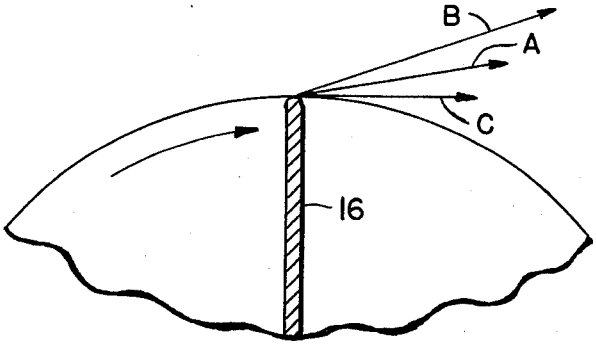
FIG. 6 is a fragmentary sectional view of the impeller showing the angles of departure of the particles having the velocity profiles shown in FIG. 5.

FIG. 5 shows a typical velocity profile 52 of fluid particles leaving impeller blade 16. Near the center of blade 16 the particles leave at supersonic speed, as shown by vector B. Toward the front shroud (member 18 of FIG. 1), the fluid particles travel slower due to frictional drag and adjacent the impeller hub 10, the particles also leave at relative slow velocities. Vectors A and C typify what happens at off-center locations. Referring now to FIG. 6, there is shown the relative angels at which the particles leave the periphery of the impeller. The supersonic fluid particles in the mid-blade region depart at higher angles than is the case for the slower or subsonic fluid particles. The slowest moving particles leave the periphery of the impeller at angles which are essentially tangent to the periphery of the impeller.

The eccentric configuration of the passageway shown in FIG. 3 readily accommodates the fan-shaped stream shown as vectors A, B and C in FIG. 6. Those supersonic particles leaving the center of the impeller blade at relatively high angles follow the slanted contour of surface 50 (see FIG. 3). The slower particles coming off the impeller at low angles travel almost tangentially until striking surface 44. The cylindrical throat section 43 having centerline B and cylindrical surfaces 42 and 44 serves to columnate the fluid coming from the impeller. Due to the velocity profile, pressure is lower near the radially inward portion of surface 42 than it is at the radially outward portion of the surface 44. As the fluid progresses out into the expanding region of each passage (Volume bounded by surfaces 46 and 48), the velocity drops, a mixing action takes place, and pressure builds up. By the time all of the compressible fluid reaches outer annulus 54 (see FIG. 1), the pressure is constant throughout and the velocity has been brought down to the hundred mile per hour range.

It is to be understood that the invention is not limited to the specific embodiment illustrated in the accompanying drawings. Changes in dimensional ratios may be required as the capacity of the diffuser is matched to a particular turbine. Bearings and seals can also be varied without departing from the spirit of the invention. The number and dimensions of the passages in the stationary diffuser stage can likewise be varied to suit design requirements.

It will be further understood that the diffuser configurations disclosed, while presently shown in cooperative arrangement with a centrifugal compressor, could function equally well in diffusing fluid flow from other devices wherein velocities range from subsonic to supersonic.

I claim:

1. A diffuser whose inner periphery closely surrounds the impeller output stage of a radial flow centrifugal compressor having a capability for delivering a compressible fluid at supersonic velocity, said diffuser comprising:

an annular entrance space for receiving the fluid discharged from said impeller, said entrance space being formed by spaced apart walls aligned respectively with the front shroud and rear hub of the impeller;

a plurality of intersecting passages extending outwardly from said annular entrance space, in a tangential direction from the inner periphery of said diffuser, each of said passages being of curvilinear cross section with an entrance throat, the centerline of said throat being stepped, said throat being contoured to match the velocity vector profiles of fluid particles delivered by said impeller, and having in the region downstream of said entrance throat an area of expanding cross section extending toward the exhaust end of said passage; and an external annulus for collecting the pressurized fluid delivered by the multiplicity of said passages.

2. The invention as defined in claim 1 wherein adjacent members of said passages intersect so as to form wedge-shaped vanes whose leading edges are elliptical in cross section.

3. The invention as defined in claim 1 wherein the entrance throat comprises three regions, an innermost region of circular cross section having a diameter equal to the axial width of the impeller, an expanding conical region which joins said innermost region to an enlarged third region of circular cross section, said innermost and said third region having parallel walls and centerlines displaced from one another such that there is a line of tangency between the two cylindrical projections.

4. The invention as defined in claim 3 wherein the expanding conical region of each of said entrance throats forms an angle of intersection with said first and said third region which is between 1° and 10°.

5. The invention as defined in claim 1 wherein said diffuser includes a radially inward extending housing along the downstream side of said impeller hub to form a back shroud around said impeller.

6. The invention as defined in claim 5 wherein said radially inward extending housing includes a rotary seal to prevent escape of pressurized gas particles.

7. The invention as defined in claim 1 wherein each of said intersecting passages comprises an innermost region of circular cross section having a diameter equal to the axial width of the impeller, said innermost region being followed by a conical region of expanding cross section which mates at its enlarged end with the surface of a right circular cylindrical section having its centerline coincident with that of said conical section but offset with respect to the centerline of said innermost region of circular cross section by an amount sufficient to assure a line of tangency between the two cylindrical projections, and said right circular cylinder being mated at its opposite end with an expanding section of passageway whose surface is a frustrum of a cone whose centerline is coincident with that of said right circular cylinder.

* * * * *